United States Patent [19]

Ojima et al.

[11] 4,419,643

[45] Dec. 6, 1983

[54] SELF-SUSTAINING SOLENOID

[75] Inventors: Shin Ojima; Kiichiro Tada, both of Yao; Toru Yoshimura, Kashihara; Naoki Yoshikawa, Sakurai; Yoshinao Naito, Nara, all of Japan

[73] Assignee: Hosiden Electronics Co., Ltd., Osaka, Japan

[21] Appl. No.: 368,251

[22] Filed: Apr. 14, 1982

[30] Foreign Application Priority Data

Apr. 22, 1981 [JP] Japan ..... 56-58366[U]

[51] Int. Cl.[3] ..... H01H 7/16

[52] U.S. Cl. ..... 335/234; 335/79; 335/230

[58] Field of Search ..... 335/234, 229, 230, 231, 335/236, 78, 79, 81

[56] References Cited

U.S. PATENT DOCUMENTS

| | | | |
|---|---|---|---|
| 3,381,181 | 4/1968 | Weathers | 335/230 |
| 3,814,376 | 6/1974 | Reinicke | 335/234 |
| 4,127,835 | 11/1978 | Knutson | 335/229 |
| 4,253,493 | 3/1981 | English | 335/234 |
| 4,306,270 | 12/1981 | Tada et al. | 335/229 |

*Primary Examiner*—Harold Broome

*Attorney, Agent, or Firm*—Pollock, Vande Sande & Priddy

[57] ABSTRACT

A self-sustaining solenoid which is adapted so that when applying an operating current to a coil, a moving iron core disposed in the coil is attracted into contact with a fixed receiver. A magnetic yoke is provided to extend between the fixed receiver and the end portion of the moving iron core projecting out of the coil, and a permanent magnet is disposed on the magnetic yoke at least at one end in the direction of movement of the moving iron core. When the moving iron core is held in contact with the fixed receiver, magnetic fluxes emanating from the permanent magnet mostly pass through the moving iron core, the fixed receiver and the magnetic yoke, and even if the operating current is cut off, the moving iron core is retained in contact with the fixed receiver. A magnetic gap is provided through which the magnetic fluxes of the permanent magnet mostly pass when the moving iron core is out of contact with the fixed receiver, and magnetic flux resulting from the application of the operating current pass through the magnetic gap.

14 Claims, 20 Drawing Figures

SELF-SUSTAINING SOLENOID

BACKGROUND OF THE INVENTION

The present invention relates to a self-sustaining solenoid which moves a moving iron core by the application of an operating current and retains the moving iron core in its moved position even if the operating current is cut off.

Heretofore there has been proposed a self-sustaining solenoid of the type in which a moving iron core is moved into contact with a fixed receiver by the application of an operating current and a permanent magnet is used as the fixed receiver to thereby ensure that the moving iron core is retained in its operative position even if the operating current is cut off. With this conventional self-sustaining solenoid, also in its released state in which the moving iron core is held out of contact with the fixed receiver, the moving iron core is exposed to an attractive force by the permanent magnet forming the fixed receiver. Accordingly, there is the possibility that the moving iron core is moved by external vibration or shock even in the released state. If the distance between the moving iron core and the fixed receiver is selected large or if a strong return spring is provided for the moving iron core with a view to prevent such an erroneous operation, then the operating current must be increased to consume much power and the solenoid structure inevitably becomes bulky.

A solution to such problems is disclosed in U.S. Pat. No. 4,306,207 entitled "Self-Sustaining Solenoid", issued on Dec. 15, 1981. In the self-sustaining solenoid set forth in this patent, a moving iron core is divided into two in the direction of its movement and a permanent magnet is interposed therebetween and, as the permanent magnet, use is made of a magnet that is readily magnetized and demagnetized at room temperature. Applying an operating current to a coil of the self-sustaining solenoid, the moving iron core is moved by magnetic flux produced by the operating current into contact with a fixed receiver and, at the same time, the permanent magnet is magnetized by the magnetic flux, so that even if the operating current is cut off, the moving iron core is retained in its operative position by the permanent magnet. When to return the moving iron core to its initial position, a release current is applied to the coil and, by a magnetic field set up by the current, the permanent magnet is demagnetized, permitting the moving iron core to return to its original position by a small returning force. In addition, since the permanent magnet is demagnetized, it does not act to attract the moving iron core and, therefore, there is no fear of erroneous operation.

But the self-sustaining solenoid proposed in the abovesaid U.S. patent is complex in construction because of the provision of the permanent magnet in the moving iron core and has to be mechanically strong because the moving iron core repeatedly strike against the fixed receiver. Therefore, the split structure of the moving iron core is undesirable. Furthermore, as the permanent magnet is demagnetized in the released state, it is necessary that during operation the moving iron core be attracted only by the magnetic flux resulting from the application of the operating current. And when to return the moving iron core to its original position, the permanent magnet has to be demagnetized, so that the release current is also large, resulting in large power consumption.

SUMMARY OF THE INVENTION

It is an object of the present invention to provide a self-sustaining solenoid which is free from the possibility of erroneous operation and is small in power consumption.

Another object of the present invention is to provide a self-sustaining solenoid which employs a simple-structured moving iron core and hence is mechanically strong.

Yet another object of the present invention is to provide a self-sustaining solenoid which is stable in its released state and is small in power consumption.

According to the present invention, in a solenoid which is arranged such that a moving iron core is movable in a coil along its axis and is attracted into the coil to be received by a fixed receiver and a magnetic yoke is provided to extend between the fixed receiver and the peripheral surface of the moving iron core at the end portion of the coil, there is provided a permanent magnet mounted on the magnetic yoke at one end thereof in the direction of movement of the moving iron core. A magnetic gap, which is smaller than the distance between the moving iron core and the fixed receiver when the moving iron core lies in its released position, is provided in a closed magnetic path of magnetic flux emanating from the permanent magnet. When the moving iron core lies in its operative position making contact with the fixed receiver, most of the magnetic flux from the permanent magnet does not pass through the magnetic gap but instead passes through a closed magnetic path running through the moving iron core and the fixed receiver. Just when the moving iron core is released to take its released or inoperative position, magnetic flux produced by an operating current applied to the coil passes through the magnetic gap in a direction reverse from the magnetic flux emanating from the permanent magnet.

In the released state, the magnetic flux by the permanent magnet mostly passes through the magnetic gap and hardly passes through the moving iron core and the fixed receiver across the gap defined therebetween, and the moving iron core hardly receives a force attracting it towards the fixed receiver, so that there is no likelihood of erroneous operation. When applying the operating current to the coil, the magnetic flux from the permanent magnet having flowed through the magnetic gap also comes to flow through the moving iron core and the fixed receiver across the gap therebetween, resulting in the attractive force for the moving iron core being increased by that. Applying the release current to the coil, the resulting magnetic flux passes through the moving iron core and the fixed receiver in a manner to cancel the magnetic flux from the permanent magnet, by which the moving iron core is readily released but the permanent magnet is not demagnetized.

By disposing the permanent magnet in opposing relation to the outer peripheral surface of the moving iron core, the moving iron core can be held in its released position more stably. The permanent magnet can be disposed opposite the outer peripheral surface of the portion of the fixed receiver projecting out from the magnetic yoke. The permanent magnet may be mounted either on the inside or on the outside of the magnetic yoke. Moreover, a plurality of permanent magnets can also be sequentially arranged with a magnetic yoke interposed between adjacent ones of them in the direction of movement of the moving iron core in such a manner that adjacent ones of the permanent magnets have their magnetic poles of the same polarity opposing to each other. In this way, the attractive force during operation can be increased. Also it is possible to provide permanent magnets on the magnetic yoke at both ends thereof in the direction of movement of the moving iron core. At any rate, the aforementioned magnetic gap is formed in the closed magnetic path of the magnetic flux from the permanent magnet.

DESCRIPTION OF THE PREFERRED EMBODIMENTS

Figure 1:
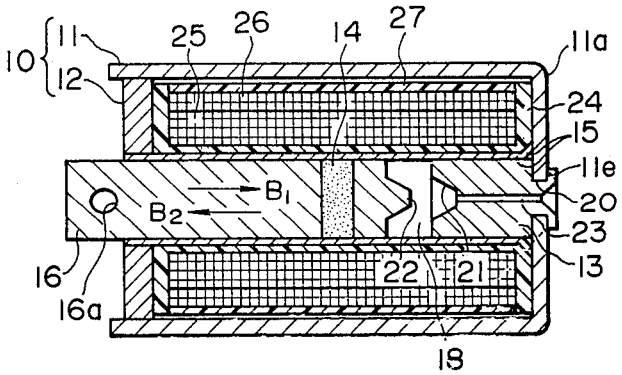
FIG. 1 PRIOR ART
FIG. 1 is a sectional view showing a conventional self-sustaining solenoid.

To facilitate a better understanding of the present invention, a description will be given first, with reference to FIG. 1, of a conventional self-sustaining solenoid. A magnetic yoke 10 comprises a magnetic yoke proper 11 produced by bending a magnetic plate into a U-letter shape and a coupling portion 12 attached to the yoke proper 11 in a manner to interconnect its both end portions. A substantially columnar-shaped fixed receiver 13 is attached to an intermediate portion 11*a* of the magnetic yoke proper 11 centrally thereof. That is to say, a hole 11*e* is made in the intermediate portion 11*a* centrally thereof and a support tube 20 projects out from the fixed receiver 13 centrally thereof on the side of the intermediate portion 11*a* and is inserted into the hole 11*e*. The projecting portion of the support tube 20 is spread out in its radial direction, by which the fixed receiver 13 is staked to the intermediate portion 11*a*. A thin through hole 23 is made in the fixed receiver 13 to extend along its axis, permitting the passage therethrough of air into and out of a gap 18 during movement of a moving iron core 16.

One end portion of a cylindrical member 15 of nonmagnetic material such, for instance, as brass, directly covers the fixed receiver 13, and the other end portion of the cylindrical member 15 is inserted into a centrally-disposed hole of the coupling portion 12 of the magnetic yoke 10. A cylindrical moving iron core or a so-called plunger 16 of substantially the same diameter as the fixed receiver 13 is inserted into the cylindrical member 15 in a manner to be slidable along the axis thereof. When the self-sustaining solenoid is in its inoperative state, the moving iron core 16 defines the air gap 18 between its inner end and the fixed receiver 13 and greatly projects out at the other end from the magnetic yoke 10.

The moving iron core 16 is divided into two in its length-wise direction, and the divided two moving iron core members are interconnected across a permanent magnet 14 having a small coercive force. The permanent magnet 14 is magnetized, at room temperature, by a magnetic field emanating from a coil of the self-sustaining solenoid during attraction and is readily demagnetized by a magnetic field reverse in direction from the abovesaid magnetic field, and this permanent magnet can repeatedly be magnetized and demagnetized. The projecting end of the moving iron core 16 has made therein a through hole 16*a* for coupling with a load.

The end face of the moving iron core 16 on the side of the fixed receiver 13 has a projection 22 formed integrally therewith to have a trapezoidal cross section including the axis of the iron core 16. In the end face of the fixed receiver 13 is formed a trapezoidal recess 21 for receiving the trapezoidal projection 22. With such an arrangement, the opposing area between the moving iron core 16 and the fixed receiver 13 increases, making it possible to increase the force that attracts the former. A bobbin 24 of a non-magnetic material such, for instance, as a synthetic resin material, is mounted on the cylindrical member 15. An operating coil 25 is wound on the bobbin 24, and a release coil 26 is further wound on the operating coil 25. A tape 27 is wrapped around the release coil 26.

Figure 2A:
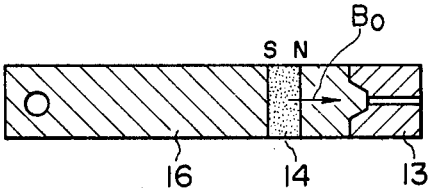
FIG. 2A PRIOR ART
FIGS. 2A and 2B are diagrams showing the relationship between magnetic fields set up by coil currents and magnetization of a permanent magnet 14 in FIG. 1.

When to attract the moving iron core 16, an operating current is applied to the operating coil 25. By the operating current, a magnetic flux $B_1$ is set up in the cylindrical member 15 substantially in parallel to the axis thereof. The magnetic flux $B_1$ passes through a closed magnetic path consisting of the magnetic yoke 10, the fixed receiver 13 and the moving iron core 16 and, by the magnetic energy of the magnetic path, the moving iron core 16 is moved toward the fixed receiver 13 to strike against it. Further, by the magnetic flux $B_1$, the permanent magnet 14 is magnetized and even if the operating current is cut off in this state, the permanent magnet 14 remains magnetized as shown in FIG. 2A and, by its magnetic flux $B_0$, the moving iron core 16 is attracted toward the fixed receiver 13 to be held thereon.

Figure 2B:
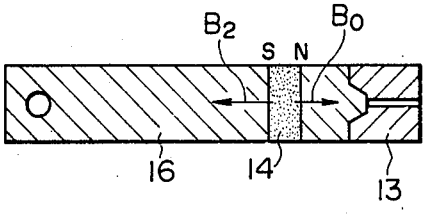
FIG. 2B PRIOR ART

Next, when to return the moving coil 16 to its initial or inoperative position, a release current is provided to the release coil 26, by which there is established in the cylindrical member 15 a magnetic flux $B_2$ substantially paralleled to the axis thereof but reverse in direction from the aforesaid magnetic flux $B_1$. As illustrated in FIG. 2B, the magnetic flux $B_2$ is opposite in direction to the magnetic flux $B_0$ of the permanent magnet 14, and hence the permanent magnet 14 is demagnetized. Accordingly, the moving iron to its initial position by means of a return spring, even if it is very weak. In this case, if the self-sustaining solenoid were used with the direction of projection of the moving iron core 16 held downward, then the moving iron core 16 would return to its original position by its own weight or a load coupled therewith, so no return spring would be needed.

The self-sustaining solenoid depicted in FIG. 1 consumes less power and is more stable in the state of the moving iron core 16 lying in its initial position than in the case where the fixed receiver 13 is formed by a permanent magnet which is not demagnetized by the magnetic fields of the coils 25 and 26. In this case, however, since the permanent magnet 14 is interposed between the divided segments of the moving iron core 16, it is difficult to construct such a small self-sustaining solenoid in which the moving iron core 16 is about 4 mm in diameter and about 15 mm long. Further, since the moving iron core 16 repeatedly strikes against the fixed receiver 13, the inserted permanent magnet 14 is also exposed to great impact; therefore, a self-sustaining solenoid of sufficient mechanical sturdiness is difficult to obtain. Moreover, as the permanent magnet 14 is repeatedly magnetized and demagnetized, power consumption is relatively large though small for each operation. In addition, during operation the permanent magnet 14 does not contribute at all to the attraction of the moving iron core 16 and it is attracted only by the magnetic flux emanating from the operating coil 25.

Figure 3:
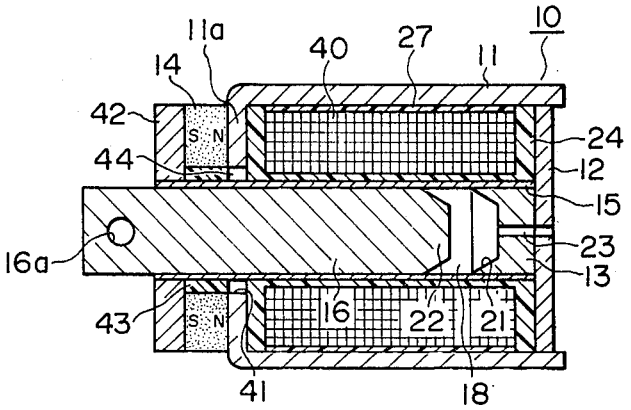
FIG. 3 is a sectional view illustrating an embodiment of the self-sustaining solenoid of the present invention in which the permanent magnet 14 is provided on the side of the projecting end of a moving iron core.

FIG. 3 illustrates an embodiment of the self-sustaining solenoid of the present invention. In FIG. 3, the parts corresponding to those in FIG. 1 are identified by the same reference numerals. In this embodiment the permanent magnet 14 is mounted on the magnetic yoke 10 on the side of the projecting end of the moving iron core 16. The moving iron core 16 projects out from the intermediate portion **11*a* of the magnetic yoke proper 11 and the fixed receiver 13 is secured to the coupling portion 12. That is to say, an opening 41 of a diameter a little larger than the outer diameter of the cylindrical member 15 is made in the intermediate portion 11*a* of the magnetic yoke proper 11 centrally thereof, and the cylindrical member 15 of a non-magnetic material is disposed in the magnetic yoke proper 11 so that it projects out therefrom through the opening 41. The permanent magnet 14 of an annular configuration, for instance, is fixed to the intermediate portion 11*a* of the magnetic yoke proper 11 around the end portion of the cylindrical member 15 projecting out from the opening 41. A magnetic path for the magnetic flux of the permanent magnet 14, which has a magnetic gap 44 smaller than the gap 18 defined between the moving iron core 16 in its released state and the fixed receiver 13, is constituted, and such an arrangement is made so that the magnetic flux of the permanent magnet 14 is prevented from passing through the magnetic gap 44 when the moving core 16 is in direct contact with the fixed receiver 13. To perform this, for example, an annular magnetic yoke 42 is fixed to the outer end face of the permanent magnet 14 around the cylindrical member 15. A gap is defined between the inner peripheral surface of the permanent magnet 14 and the outer peripheral surface of the cylindrical member 15, and the magnetic gap 44 of the same as or smaller than this gap is defined between the inner peripheral surface of the opening 41 and the outer peripheral surface of the moving iron core 16. The magnetic gap 44 is selected to be smaller than the gap 18 between the fixed receiver 13 and the moving iron core 16. A ring-shaped spacer 43 of a non-magnetic material, such as brass, is inserted between the cylindrical member 15 and the permanent magnet 14 as required. The spacer 43 may also be extended to fill up the magnetic gap 44. As the permanent magnet 14, for instance, a ferrite magnet, rare earth magnet or the like having relatively a high coercive force is employed. In FIG. 3, the permanent magnet 14 has its north and south poles on the side of the intermediate portion 11*a* and on the side of the magnetic yoke 42, respectively. Furthermore, in this embodiment, one coil 40 is wound on the bobbin 24**.

Figure 4:
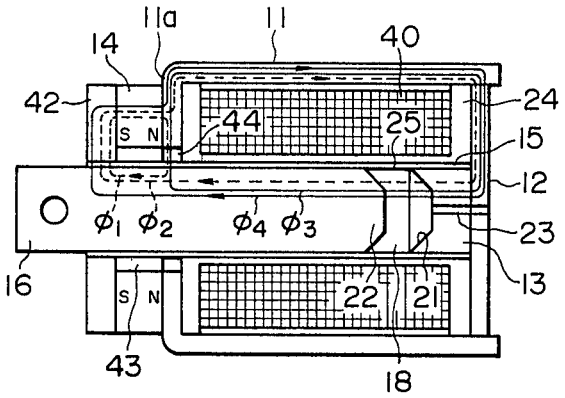
FIG. 4 is a schematic diagram showing a magnetic path of magnetic flux from the permanent magnet in the released state and a magnetic path of magnetic flux produced by a release current in the embodiment of FIG. 3.

As illustrated in FIG. 4, when the moving iron core 16 and the fixed receiver 13 are spaced apart, the magnetic fluxes emanating from the permanent magnet 14 set up two closed magnetic paths in the solenoid. That is to say, a first closed magnetic path is formed via a route [magnetic pole N - intermediate portion **11*a* - gap 44 -cylindrical member 15 - moving iron core 16 - cylindrical member 15 - magnetic yoke 42 - magnetic pole S], and a flux $\phi_1$ is confined in the first closed magnetic path. A second closed magnetic path is formed via a route [magnetic pole N - intermediate portion 11*a* - magnetic yoke proper 11 -coupling portion 12 - fixed receiver 13 - gap 18 - moving iron core 16 - cylindrical member 15 - magnetic yoke 42 - magnetic pole S], and a magnetic flux $\phi_2$ is confined in the second closed magnetic path. In the second closed magnetic path, as the magnetic resistance in the gap 18 is markedly higher than in the gap 44, the magnetic flux $\phi_2$ confined in the second closed magnetic path is appreciably smaller in quantity than the magnetic flux $\phi_1$ confined in the first closed magnetic path, where it approximately holds that $\phi_1+\phi_2=\phi_M$ which is the total flux obtained from the permanent magnet 14 and does not vary. Consequently, in the state in which neither of the operating and release current is applied to an operating and release coil 40, the moving iron core 16 would not be moved by the magnetic energy of the second closed magnetic path because the magnetic flux $\phi_2$ is small in quantity. Owing to the magnetic energy of the first closed magnetic path, the moving iron core 16** attempts to remain there when external force is applied thereto.

Next, an operating current is applied to the operating and release coil 40 so that the direction of the magnetic flux in the core 16 produced by the coil 40 may coincide with that of the flux $\phi_2$ from the magnet 14. In this case, the magnetic fluxes yielded by the operating current constitute two closed magnetic paths in the solenoid. That is to say, a third closed magnetic path is formed via a route [intermediate portion 11*a* - magnetic yoke proper 11 - coupling portion 12 - fixed receiver 13 - gap 18 - moving iron core 16 - cylindrical member 15 - gap 44 - intermediate portion 11*a*], and a magnetic flux $\phi_3$ is confined in the third closed magnetic path. A fourth closed magnetic path is formed via a route [magnetic pole N - intermediate portion 11*a* - magnetic yoke proper 11 -coupling portion 12 - fixed receiver 13 - gap 18 - moving iron core 16 - cylindrical member 15 - magnetic yoke 42 - magnetic pole S], and a magnetic flux $\phi_4$ is confined in the fourth closed magnetic path.

Figure 5:
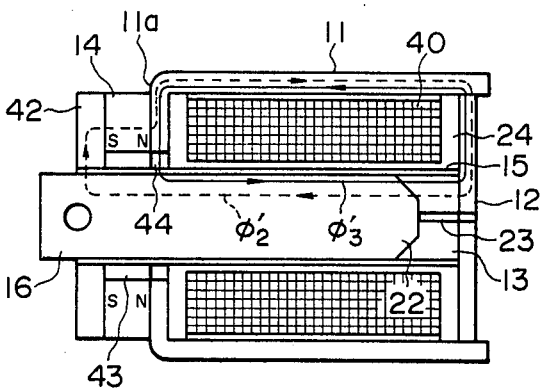
FIG. 5 is a schematic diagram showing a magnetic path of magnetic flux from the permanent magnet in the operative state and a magnetic path of magnetic flux produced by an operating current in the embodiment of FIG. 3.

In that portion of the moving iron core 16 which stays in the operating and release coil 40, magnetic fluxes $\phi_2+\phi_3+\phi_4$ exist along the axis of the moving iron core 16 during the application of the operating current. By these magnetic fluxes, the moving iron core 16 is subjected to a force which moves it towards the fixed receiver 13. In this case, the magnetic fluxes $\phi_1$ and $\phi_3$ are opposite in direction in the gap 44. Therefore, when the flux $\phi_3$ becomes larger than the flux $\phi_1$, the flux $\phi_1$ is forced to take the second closed magnetic path. Consequently, the force that the moving iron core 16 receives becomes larger than in the case where it is exposed only to the magnetic flux emanating from the coil 40. In this way, the moving iron core 16 is moved towards the fixed receiver 13 by the magnetic energy of the second, third and fourth closed magnetic paths, resulting in the projection 22 being snugly fitted into the trapezoidal recess 21. In this state, as the gap 18 does not exist, the magnetic resistance value of the second closed magnetic path is far smaller than in the case where the moving iron core 16 and fixed receiver 13 are not in contact with each other. Accordingly, the quantity of the magnetic flux $\phi_2'$ which is confined in the second closed magnetic path as shown in FIG. 5 becomes far larger than the magnetic flux $\phi_2$. In contrast thereto, since the magnetic resistance value of the first closed magnetic path markedly increases larger than the magnetic value of the second closed magnetic path by virtue of the presence of the gap 44, substantially no magnetic fluxes are confined in the first closed magnetic path. As the quantity of the magnetic flux $\phi_2'$ confined in the second closed magnetic path increases as described above, the moving iron core 16 is held in contact with the fixed receiver 13 by the magnetic energy of the second closed magnetic path even the operating current is cut off.

When to return the moving iron core 16 to its initial position, a release current is applied to the operating and release coil 40 in a direction opposite to the operating current. In this case, as shown in FIG. 5, a closed magnetic path is set up via a route [intermediate portion 11*a* - gap 44 - moving iron core 16 - fixed receiver 13 - coupling member 12 - magnetic yoke proper 11 -intermediate portion 11*a*], and a magnetic flux $\phi_3'$ is confined in this closed magnetic path. Since the magnetic flux $\phi_3'$ is reverse in direction from the magnetic flux $\phi_2'$ in the axial direction of the moving iron core 16, and hence it cancels the magnetic flux $\phi_2'$ emanating from the permanent magnet 14, by which the force of the permanent magnet 14 attracting the moving iron core 16 is reduced to almost zero, resulting in the moving iron core 16 being capable to be returned by a very weak force. In practice, since the moving iron core is usually brought back to its original position by the aid of a return spring or through utilization of its own weight, the iron core 16 can be returned with much less release current.

In the conventional solenoid depicted in FIG. 1, during its return operation the permanent magnet 14 has to be demagnetized, and consequently a relatively larger release current is needed for the return operation. In contrast thereto, according to the solenoid of the present invention, the permanent magnet 14 need not be demagnetized and the moving iron core 16 is returned by applying a relatively small release current to the operating and release coil 40. Moreover, in the solenoid of the present invention, during operation the magnetic flux of the permanent magnet 14 also acts to attract the moving iron core 16 as described previously, so that the operating current may be smaller than is required in the case of the prior art solenoid shown in FIG. 1. For the reasons described above, according to the solenoid of the present invention, the release current as well as the operating current are smaller than those needed in the prior art solenoid and hence the power consumption is small.

Figure 6:
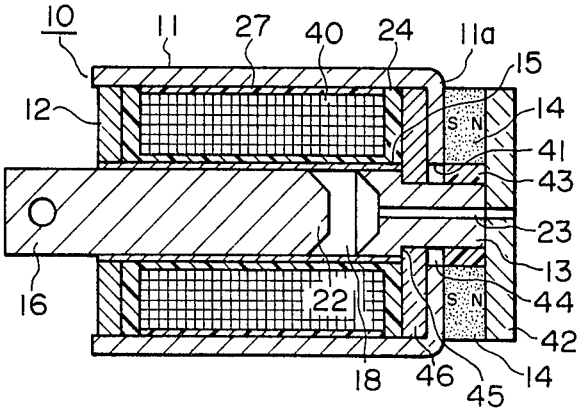
FIG. 6 is a sectional view illustrating another embodiment of the self-sustaining solenoid of the present invention in which the permanent magnet is provided on the side of the fixed receiver.

FIG. 6 illustrates another embodiment of the self-sustaining solenoid of the present invention, in which the parts corresponding to those in FIG. 3 are identified by the same reference numerals. In this embodiment the permanent magnet 14 is mounted on the end face of the magnetic yoke 10 on the side of the fixed receiver 13, and the moving iron core 16 projects out from the coupling member 12 as in the case of FIG. 1. On the other hand, the fixed receiver 13 is extended in its axial direction and the extended portion projects out of the opening 41 of the intermediate portion 11*a*. The extended portion of the fixed receiver 13 is reduced in diameter to form a stepped portion 45. Interposed between the intermediate portion 11*a* and the bobbin 24 is a square-shaped, non-magnetic spacer 46 having made therein a circular hole, into which the extended portion is inserted to engage its stepped portion 45 with the spacer 46. The magnetic gap 44 is defined between the outer peripheral surface of the fixed receiver 13 and the inner peripheral surface of the opening 41 of the intermediate portion 11*a*. The circular permanent magnet 14 is mounted on the intermediate portion 11*a* on the opposite side from the bobbin 24, and the projecting end portion of the fixed receiver 13 is inserted into the permanent magnet 14, with a gap defined therebetween. A spacer 43 is disposed in the gap as required. The magnetic yoke 42 attached to the outer end face of the permanent magnet 14 is made disc-shaped, and the end face of the fixed receiver 13 abuts against the magnetic yoke 42. When the moving iron core 16 lies at its outermost position, the main magnetic flux of the permanent magnet 14 sets up a magnetic path via a route [magnetic pole N - magnetic yoke 42 - fixed receiver 13 - magnetic gap 44 - intermediate portion 11*a* - magnetic pole S] and does not act on the moving iron core 16. When applying the operating current to the coil 40, magnetic flux is produced which is reverse in direction in the magnetic gap 44 from the magnetic flux emanating from the permanent magnet 14. Consequently, the magnetic flux from the permanent magnet 14 diverts into a magnetic path via a route [magnetic pole N - magnetic yoke 42 - fixed receiver 13 - gap 18 - moving iron core 16 - coupling member 12 - magnetic yoke proper 11 - intermediate portion 11*a* - magnetic pole S]. The magnetic flux of the permanent magnet 14 also serves to attract the moving iron core 16, and when the moving iron core 16 is in contact with the fixed receiver 13, the former is held in its operating position by the magnetic flux of the permanent magnet 14. When to return the moving iron core 16, a release current is applied to the coil 40 to yield magnetic flux which cancels the magnetic flux of the permanent magnet 14 in the moving iron core 16.

Figure 7:
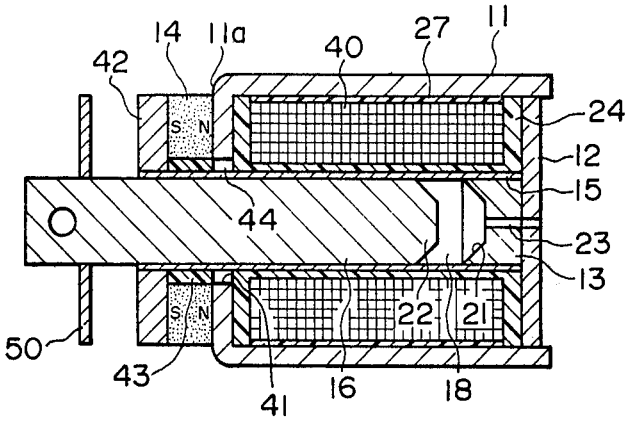
FIG. 7 is a sectional view illustrating a modified form of the embodiment of FIG. 3.

FIG. 7 illustrates another embodiment of the self-sustaining solenoid of the present invention, in which the parts corresponding to those in FIG. 3 are identified by the same reference numerals. In this embodiment, for instance, a disc-shaped flange 50 of a magnetic material is mounted by means of press-in, staking or monoblock casting on that portion of the moving iron core 16 projecting out of the magnetic yoke 42. The spacing between the magnetic yoke 42 and the flange 50 in the inoperative state of the moving iron core 16 is selected to be substantially the same as the gap 18 so that the flange 50 may contact over the entire area of its surface with the magnetic yoke 42 when the moving iron core 16 makes contact with the fixed receiver 13. Accordingly, when the moving iron core 16 is in contact with the fixed receiver 13, the aforementioned second closed magnetic path runs through the flange 50 of the magnetic material instead of running through the non-magnetic cylindrical member 15. In this case, the second closed magnetic path is established via a route [magnetic pole N - intermediate portion 11*a* - magnetic yoke proper 11 - coupling portion 12 - fixed receiver 13 - moving iron core 16 - flange 50 - magnetic yoke 42 - magnetic pole S]. Therefore, magnetic flux does not pass through the cylindrical member 15 but instead passes through the flange 50 of low magnetic resistance, so that the flux confined within the second closed magnetic path increases, permitting an increases in the force of retaining the moving iron core 16. It has been found that a solenoid without the flange 50 having a retaining force of about 1500 g was increased up to 2600 g by the provision of the flange 50.

Figure 8:
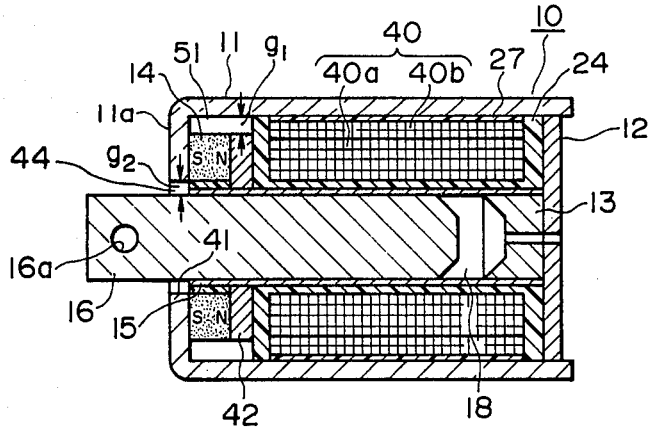
FIG. 8 is a sectional view illustrating another modification of the embodiment of FIG. 3 in which the permanent magnet 14 is disposed on the inside of the magnetic yoke.
Figure 9:
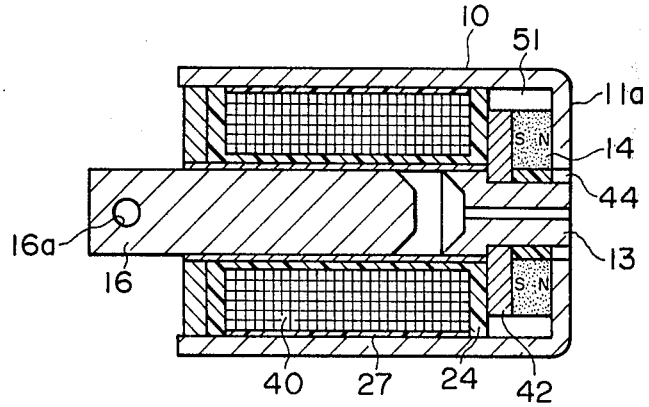
FIG. 9 is a sectional view illustrating a modified form of the embodiment of FIG. 6 in which the permanent magnet 14 is disposed on the inside of the magnetic yoke.

While in the foregoing embodiments the permanent magnet 14 is described to be mounted on the outside of one end of the magnetic yoke 10, it may also be attached to the inside of the magnetic yoke 10. For instance, in the case where the permanent magnet 14 is attached to the magnetic yoke 10 on the side of the projecting end of the moving iron core 16 as shown in FIG. 3, the permanent magnet 14 is mounted on the inside of the magnetic yoke 10 in contact therewith as depicted in FIG. 8 and the magnetic yoke 42 is interposed between the permanent magnet 14 and the flange of the bobbin 24. In this case, the size $g_1$ of a gap 51 defined between the outer peripheral surface of the magnetic yoke 42 and the magnetic yoke 10 is selected sufficiently larger than the size $g_2$ of the gap 44 between the inner peripheral surface of the opening 41 of the magnetic yoke 10 and the moving iron core 16 so that the magnetic flux passing through the gap 51 may be negligibly small. When the magnetic flux by the operating current applied to a coil 40*a* passes through the gap 44 in a direction reverse from the magnetic flux of the permanent magnet 14, the magnetic flux of the permanent magnet 14 sets up a magnetic path via a route [magnetic pole N - magnetic yoke 42 - moving iron core 16 - fixed receiver 13 - coupling portion 12 - magnetic yoke proper 11 -intermediate portion 11*a* - magnetic pole S] without passing through the gap 44, thus attracting the moving iron core 16 to the fixed receiver 13. When applying the release current to a coil 40*b*, there is produced magnetic flux which is opposite in direction to the magnetic flux of the permanent magnet 14 directed from the moving iron core 16 to the fixed receiver 13, disconnecting the moving iron core 16 from the fixed receiver 13. The magnetic flux emanating from the coil 40*b* and the magnetic flux of the permanent magnet 14 passing through the gap 44 coincide in direction, so that the magnetic flux emanating from the permanent magnet 14 selects the magnetic path including the gap 44. In the embodiment of FIG. 8, the coil 40 is made up of the operating and release coils 40*a* and 40*b*, and the provision of such two coils is also applicable to the other embodiments of the present invention described herein. In other words, in the self-sustaining solenoid of the present invention, the operating and the release current may be supplied to individual coils or the same coil. Similarly, also in the embodiment of FIG. 6 in which the permanent magnet 14 is mounted on the magnetic yoke 10 on the side of the fixed receiver 13, the permanent magnet 14 can be mounted inside the magnetic yoke 10 as shown in FIG. 9, in which the parts corresponding to those in FIGS. 6 and 8 are identified by the same reference numerals though no description will be repeated.

Figure 10:
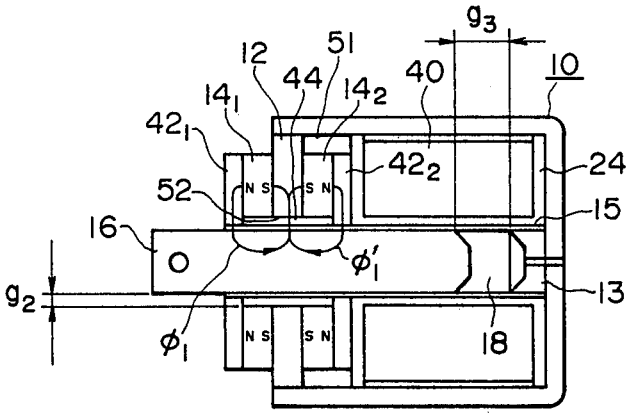
FIG. 10 is a sectional view illustrating another embodiment of the present invention in which a plurality of permanent magnets are provided on the side of the projecting end of the moving iron core.

Although in the foregoing only one permanent magnet 14 is disposed on one end of the magnetic yoke 10, it is also possible that a plurality of permanent magnets are sequentially arranged with a magnetic yoke interposed between adjacent of them in the direction of movement of the moving iron core 16 in such a manner that adjacent ones of the permanent magnets may be of the same polarity so as to increase the attractive force for actuating the moving iron core 16 and to increase the force for holding the moving iron core 16 in contact with the fixed receiver 13. FIG. 10 shows an example of such an arrangement. This is a combination of the arrangements of FIGS. 3 and 6, and the moving iron core 16 projects out from an opening 52 of the coupling portion 12 of the magnetic yoke 10. On the outside and inside of the coupling portion 12 are mounted permanent magnets $14_1$ and $14_2$, and magnetic yoke $42_1$ and $42_2$, respectively. The permanent magnets $14_1$ and $14_2$ have their magnetic poles of the same polarity opposing to each other across the coupling portion 12 of the magnetic yoke 10. The gap 44 is defined between the inner peripheral surface of the opening 52 of the coupling portion 12 and the outer peripheral surface of the moving iron core 16, and its size $g_2$ is selected smaller than that $g_3$ of the gap 18.

Figure 11:
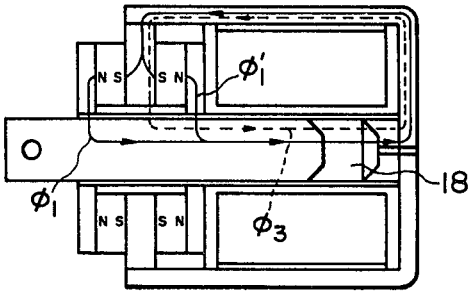
FIG. 11 is a diagram showing a magnetic path of magnetic flux from the permanent magnets in the released state and a magnetic path of magnetic flux produced by an operating current in the embodiment of FIG. 10.

When the moving iron core 16 is out of contact with the fixed receiver 13, magnetic fluxes $\phi_1$ and $\phi_1'$ emanating from the respective permanent magnets $14_1$ and $14_2$ are each confined in a closed magnetic path in which they pass through the gap 44 in the same direction as shown, and these magnetic fluxes do not pass through the gap 18 and, consequently, the moving iron core 16 is not attracted by the permanent magnets $14_1$ and $14_2$. The permanent magnets $14_1$ and $14_2$ would rather serve to retain the moving iron core 16 at its outermost position against an external force when applied thereto by chance. When applying an operating current to the coil 40 to produce a magnetic flux $\phi_3$ which passes through the gap 44 in a direction opposite to the magnetic fluxes $\phi_1$ and $\phi_1'$ emanating from the permanent magnets $14_1$ and $14_2$ as illustrated, the magnetic fluxes $\phi_1$ and $\phi_1'$ divert to pass through the gap 18 instead of the gap 44 as shown in FIG. 11. As a result of this, the moving iron core 16 is exposed to the magnetic fluxes $\phi_1$ and $\phi_1'$ as well as $\phi_3$; namely, the attractive force is larger than is obtainable in the embodiment of FIG. 3.

Figure 12:
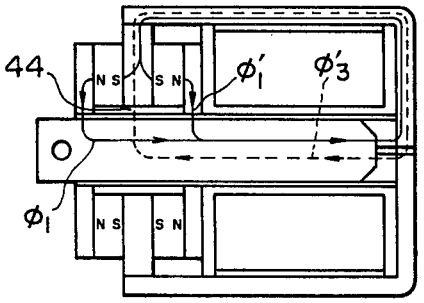
FIG. 12 is a diagram showing a magnetic path of the magnetic flux from the permanent magnets in the operative state and a magnetic path of magnetic flux produced by a release current in the embodiment of FIG. 10.

Even if the operating current is cut off when the moving iron core 16 is in contact with the fixed receiver 13, the magnetic fluxes $\phi_1$ and $\phi_1'$ pass through the moving iron core 16 and the fixed receiver 13 instead of passing through the gap 44 as shown in FIG. 12, thus maintaining the moving iron core 16 in its operative position. Since this retaining force is derived from both the magnetic fluxes $\phi_1$ and $\phi_1'$, it is larger than in the case of one permanent magnet being used. When to return the moving iron core 16 to its initial or inoperative position, a release current is applied to the coil 40 to yield a magnetic flux $\phi_3'$ which is reverse in direction from the magnetic fluxes $\phi_1$ and $\phi_1'$ as the broken line in FIG. 12.

In the case of a plurality of permanent magnets being provided, it is also possible to adopt such an arrangement that the magnetic fluxes of the respective permanent magnets pass through individual gaps when the moving iron core 16 lies in its outermost or inoperative position. For instance, as depicted in FIG. 13 in which the parts corresponding to those in FIG. 10 are identified by the same reference numerals, the magnetic yokes on the outside of the permanent magnets $14_1$ and $14_2$ are coupled as coupling portions $12_1$ and $12_2$ with the both end portions of the magnetic yoke proper 11, and gaps $44_1$ and $44_2$ are defined between the inner peripheral surfaces of the openings $52_1$ and $52_2$ of the coupling portions $12_1$ and $12_2$ and the outer peripheral surface of the moving iron core 16, and then the magnetic yoke 42 is interposed between the permanent magnets $14_1$ and $14_2$.

Figure 13:
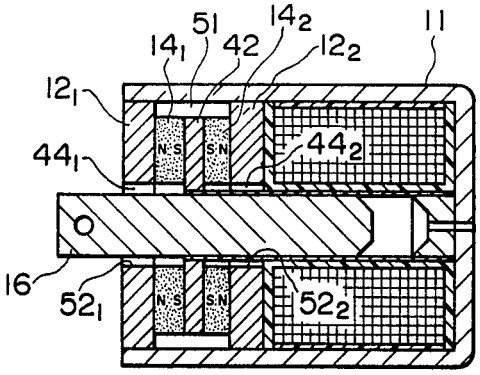
FIG. 13 is a sectional view illustrating a modified form of the embodiment of FIG. 10.
Figure 14:
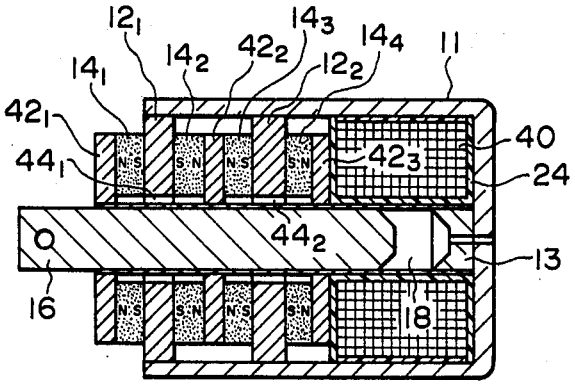
FIG. 14 is a sectional view illustrating another modification of the embodiment of FIG. 10 in which the number of permanent magnets used is increased.
Figure 15:
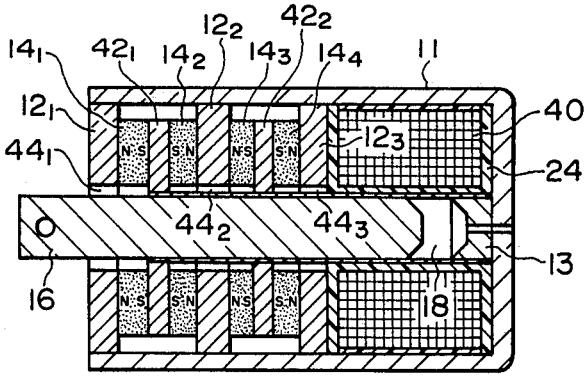
FIG. 15 is a sectional view illustrating a modification of the embodiment of FIG. 13 in which the number of permanent magnets used is increased.

More permanent magnets may also be provided as illustrated in FIGS. 14 and 15 which correspond to FIGS. 10 and 13, respectively. In FIGS. 14 and 15, four permanent magnets $14_1$ to $14_4$ are employed. In FIGS. 14 and 15, those of magnetic yokes disposed on both sides of the permanent magnet $14_i$ (i=1, 2, . . . ) which are coupled with the magnetic yoke proper 11 are identified by $12_i$ (i=1, 2, . . . ) and those which are magnetically coupled with the core 16 are identified by $42_i$ (i=1, 2, . . . ). The magnetic yokes $12_i$ and $42_i$ are arranged alternately and the gaps $44_i$ are defined between the magnetic yoke $12_i$ and the moving iron core 16. The adjacent ones of the permanent magnets $14_1$ to $14_4$ have their magnetic poles of the same polarity opposing to each other across the magnetic yoke.

Figure 16:
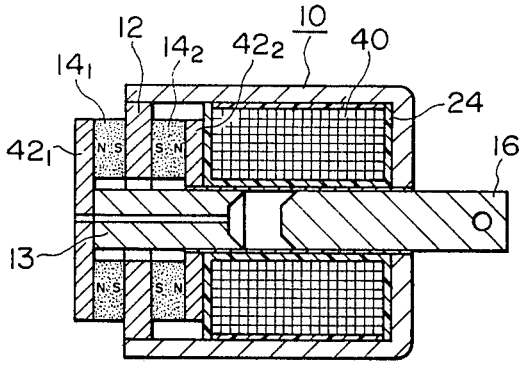
FIG. 16 is a sectional view illustrating another embodiment of the present invention in which a plurality of permanent magnets are provided on the side of the fixed receiver.
Figure 17:
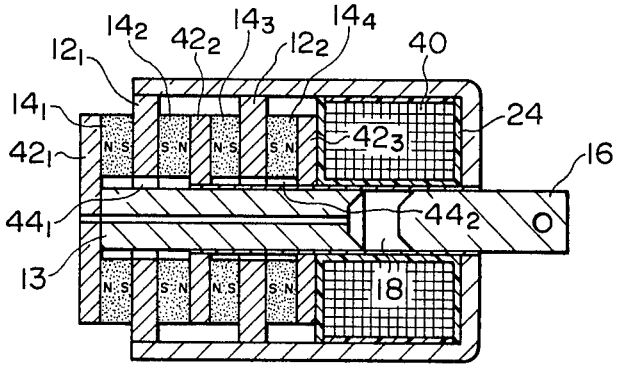
FIG. 17 is a sectional view illustrating a modified form of the embodiment of FIG. 16 in which the number of permanent magnets used is increased.
Figure 18:
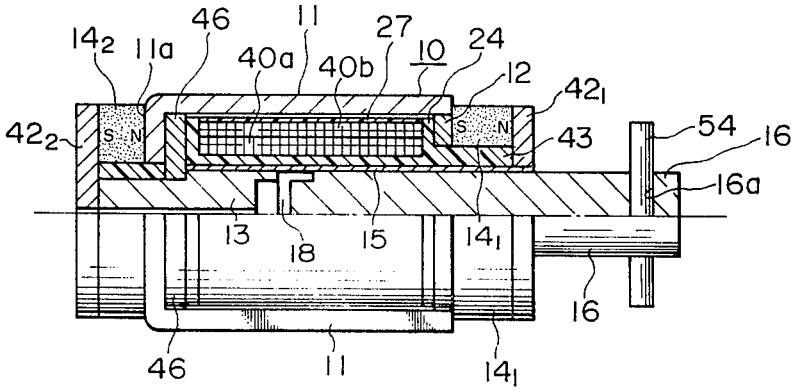
FIG. 18 is a front view, partly in section, illustrating another embodiment of the present invention in which pluralities of permanent magnets are provided on the side of the projecting end of the moving iron core and on the side of the fixed receiver.

Also in the case where the permanent magnet 14 is provided on the magnetic yoke 10 on the side of the fixed receiver 13 as shown in FIGS. 6 and 9, a plurality of permanent magnets can be employed as illustrated in FIGS. 16 and 17 in which the parts corresponding to those in FIGS. 6, 9, 14 and 15 are identified by the same reference numerals though not described in detail. Further, although in the foregoing a permanent magnet is disposed only on one end of the magnetic yoke 10 in the direction of travel of the moving iron core 16, permanent magnets may also be disposed on both ends of the magnetic yoke 10. Its specific example is depicted in FIG. 18, in which the parts corresponding to those in FIGS. 3 and 6 are identified by the same reference numerals, and no detailed description will be given. In FIG. 18, the spacer 43 between the permanent magnet $14_1$ and the cylindrical member 15 is formed as a unitary structure with the bobbin 24, and a pin 54 for engagement with a load is fixedly inserted into the load engaging hole **16*a* of the moving iron core 16**. Such modifications are applicable to the above-described embodiments as well.

Figure 19:
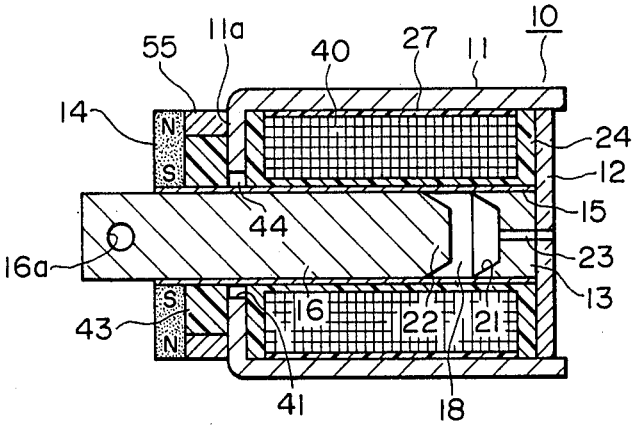
FIG. 19 is a sectional view illustrating another modification of the embodiment of FIG. 3, where the permanent magnet has magnetization in a radial direction.

In the foregoing embodiments, the permanent magnet(s) 14 has been described as to have its magnetization direction in parallel to the direction of the movement of the iron core 16, but it is also possible to use a permanent magnet having a magnetization in a radial direction as illustrated in FIG. 19, in which parts corresponding to those in FIG. 3 are identified by the same numerals. The permanent magnet 14 has also an annular shape and has magnetization in a radial direction. One of the magnetic poles of the permanent magnet 14 is magnetically coupled with the moving iron core 16 and the other pole is coupled with the intermediate portion **11*a* via a ring-shaped coupling yoke 55. Particularly, when adopting such a permanent magnet 14 shown in FIG. 19 into the embodiment of FIG. 8, for example, the permanent magnet 14 can be inserted between the yoke proper 11 and the moving iron core 16 to magnetically couple therewith in a close relation, and the space originally occupied by the magnet 14 in FIG. 8** can be left vacant or filled with a nonmagnetic space.

Moreover, in any of the foregoing embodiment, a plurality of permanent magnets may also be disposed at equal intervals around the moving iron core 16 or the fixed receiver 13 in place of the single ring-shaped permanent magnet. Besides, the magnetic yoke proper 11 may also be tubular in shape. In the case where a plurality of permanent magnets are arranged in the direction of movement of the moving iron core 16, the number of permanent magnets used may be odd as will easily be seen from the fact that even if the outermost permanent magnet $14_1$ and magnetic yoke $42_1$ were removed, for instance, in FIG. 14 the operation of the self-sustaining solenoid would be carried out.

It will be apparent that many modifications and variations may be effected without departing from the scope of the novel concepts of the present invention.

What is claimed is:

1. A self-sustaining solenoid comprising:

operating and release coil means supplied with an operating and a release current;

a moving magnetic core disposed in the operating and release coil means substantially coaxially therewith in a manner to be movable along the axis thereof, one end of the moving magnetic core projecting out from one end of the coil means;

a fixed receiver disposed in the operating and release coil means at one end thereof, for receiving the moving magnetic core when the latter is attracted into the operating and release coil means, the fixed receiver being made of a magnetic material;

magnetic yoke means provided on the outside of the operating and release coil means to extend between the fixed receiver and the outer peripheral surface of the moving magnetic core for magnetic connection therebetween;

permanent magnet means disposed near at least one of the magnetically connecting portions between the magnetic yoke means and the moving magnetic core and between the magnetic yoke means and the fixed receiver in such a manner that one of the magnetic poles of the permanent magnet means is magnetically connected to the magnetic yoke means and the other pole of the permanent magnet means is magnetically connected to at least one of the moving magnetic core and the fixed receiver on which side the permanent magnet means is disposed, magnetic fluxes emanating from the permanent magnet means being mostly confined within a closed magnetic path running through the moving magnetic core, the fixed receiver and the magnetic yoke means when the moving magnetic core is in contact with the fixed receiver; and magnetic gap means provided in at least one of the magnetically connecting portions between the both ends of the magnetic yoke means and the moving magnetic core and the fixed receiver on which side the permanent magnet means is disposed, the magnetic gap means having a size smaller than the distance between the moving magnetic core and the fixed receiver in the state of the former being held in its released position spaced apart from the latter and being so designed as to permit the passage therethrough most of the magnetic fluxes of the permanent magnet means when the moving magnetic core is held at its released position.

2. A self-sustaining solenoid according to claim 1 wherein one end face of the magnetic yoke means in the direction of movement of the moving magnetic core is formed as an end plate having an opening made therein; one of the moving magnetic core and the fixed receiver is disposed in the opening; and the magnetic gap means is defined between the outer peripheral surface of one of the moving magnetic core and the fixed receiver and the inner peripheral surface of the opening.

3. A self-sustaining solenoid according to claim 1 wherein one end face of the magnetic yoke is formed as an end plate; the moving magnetic core projects out through an opening made in the end plate; one of the magnetic poles of the permanent magnet means is contacted with one of the outside and inside surfaces of the end plate; a plate-shaped magnetic yoke having a hole receiving the moving magnetic core is contacted with the other magnetic pole of the permanent magnet means; and the magnetic gap means is defined between the inner peripheral surface of the opening of the end plate and the outer peripheral surface of the moving magnetic core.

4. A self-sustaining solenoid according to claim 1 wherein one end of the magnetic yoke means is formed as an end plate having an opening; the fixed receiver is inserted into the opening; one of the magnetic poles of the permanent magnet means is contacted with one of the inside and outside surfaces of the end plate; a plate-shaped magnetic yoke magnetically tightly coupled with the fixed receiver is contacted with the other magnetic pole of the permanent magnet means; and the magnetic gap is defined between the outer peripheral surface of the fixed receiver and the inner peripheral surface of the opening.

5. A self-sustaining solenoid according to claim 1 wherein the permanent magnet means comprises a plurality of permanent magnets arranged in the direction of movement of the moving magnetic core with the same polarity of the adjacent permanent magnets facing each other; a plurality of plate-shaped magnetic yokes are provided each between adjacent ones of the permanent magnets and on both sides of the arrangement of the permanent magnets in contact therewith so that alternate ones of the plate-shaped magnetic yokes are contacted with the magnetic yoke means to achieve the magnetic connection between the permanent magnet means and the magnetic yoke means and the remaining ones of the plate-shaped magnetic yokes are magnetically coupled with one of the moving magnetic core and the fixed receiver to achieve the magnetic connection between the permanent magnet means and said one of the moving magnetic core and the fixed receiver; and there are provided a plurality of gaps each between said alternate ones of the plate-shaped magnetic yokes and said one of the moving magnetic core and the fixed receiver to form said magnetic gap means.

6. A self-sustaining solenoid according to claim 1 wherein the permanent magnet means comprises first and second permanent magnets respectively disposed on the magnetic yoke at both sides thereof in the direction of movement of the moving magnetic core; the first and second permanent magnets are magnetized in the direction of movement of the moving magnetic core; magnetic fluxes emanating from the first and second permanent magnets mostly pass through the moving magnetic core, the fixed receiver and the magnetic yoke means in the state of the moving iron magnetic core being in contact with the fixed receiver; the magnetic gap means comprises first and second magnetic gaps formed between both ends of the magnetic yoke means and the moving magnetic core and the fixed receiver, the first and second magnetic gaps being smaller than the distance between the moving magnetic core and the fixed receiver in the state of the former being held in its released position spaced apart from the latter and through which the magnetic fluxes of the first and second permanent magnets mostly pass; and magnetic flux resulting from the application of an operating current to the operating and release coil means pass through the first and second magnetic gaps.

7. A self-sustaining solenoid according to any one of claims 1 to 6 wherein the permanent magnet means is ring-shaped and magnetized in its axial direction.

8. A self-sustaining solenoid according to any one of claims 1 to 3 wherein the permanent magnet means is ring-shaped and magnetized in its radial direction.

9. A self-sustaining solenoid according to any one of claims 1 to 6 wherein a non-magnetic spacer is interposed between the permanent magnet means and one of the moving magnetic core and the fixed receiver disposed opposite thereto.

10. A self-sustaining solenoid according to any one of claims 1 to 6 wherein the operating and release coil means is composed of an operating coil supplied with an operating current and a release coil disposed coaxially with the operating coil and supplied with a release current.

11. A self-sustaining solenoid according to claim 3 wherein the permanent magnet means is disposed on the outside of the end plate; and a spacer formed as a unitary structure with a bobbin for the operating and release coil means extended between the permanent magnet means and the moving magnetic core across the magnetic gap means.

12. A self-sustaining solenoid comprising:

operating and release coil means supplied with an operating and release current;

a moving magnetic core disposed in the operating and release coil means sunbstantially coaxially therewith in a manner to be movable along the axis thereof, one end of the moving magnetic core projecting out from one end of the coil means;

a fixed receiver disposed in the operating and release coil means at one end thereof, for receiving the moving magnetic core when the latter is attracted into the operating and release coil means, the fixed receiver being made of a magnetic material;

first magnetic yoke means disposed on the outside of the coil means to extend in the direction of movement of the moving magnetic core;

second magnetic yoke means magnetically coupled with one end of the first magnetic yoke and disposed to extend substantially perpendicularly to the direction of movement of the moving magnetic core and magnetically tightly coupled with one of the moving magnetic core and the fixed receiver;

permanent magnet means disposed substantially intermediate between the other end of the first magnetic yoke means and the other of the moving magnetic core and the fixed receiver and magnetized in the direction of movement of the moving magnetic core;

third magnetic yoke means magnetically coupled with one of the magnetic poles of the permanent magnet means and magnetically tightly coupled with the other of the moving magnetic core and the fixed receiver;

fourth magnetic yoke means magnetically coupled with the other pole of the permanent magnet and the first magnetic yoke means and defines a magnetic gap between it and the other of the moving magnetic core and the fixed receiver;

wherein the length of the magnetic gap is smaller than the distance between the moving magnetic core lying in its released position and the fixed receiver; in the state of the moving magnetic core and the fixed receiver being in contact with each other, magnetic fluxes emanating from the permanent magnet means mostly pass through the first magnetic yoke means without passing through the magnetic gap; and in the state of the moving magnetic core being held in its released position, the magnetic fluxes of the permanent magnet means mostly pass through the magnetic gap.

13. A self-sustaining solenoid according to claim 12 wherein the permanent magnet means is composed of a plurality of permanent magnets arranged in the direction of movement of the moving magnetic core; and magnetic yokes are respectively disposed between adjacent ones of the permanent magnets and on both sides of their arrangement, alternate ones of the magnetic yokes constituting the third magnetic yoke means and the other alternate magnetic yokes constituting the fourth magnetic yoke means.

14. A self-sustaining solenoid according to claim 3 wherein adjacent ones of the plurality of permanent magnets have their magnetic poles of the same polarity opposing to each other.

* * * * *